US007515163B2

(12) United States Patent
Suzuki et al.

(10) Patent No.: US 7,515,163 B2
(45) Date of Patent: Apr. 7, 2009

(54) PRINTER

(75) Inventors: Kazutaka Suzuki, Fukushima-ken (JP); Hiroyuki Murayama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 72 days.

(21) Appl. No.: 11/673,421

(22) Filed: Feb. 9, 2007

(65) Prior Publication Data

US 2007/0188586 A1 Aug. 16, 2007

(30) Foreign Application Priority Data

Feb. 14, 2006 (JP) ..... 2006-036523

(51) Int. Cl.
*B41J 2/325* (2006.01)

(52) U.S. Cl. ..... 347/173

(58) Field of Classification Search ..... 347/172, 347/173; 400/120.01, 120.02, 120.04
See application file for complete search history.

(56) References Cited

U.S. PATENT DOCUMENTS 7,119,821 B2 * 10/2006 Mogi ..... 347/171
2007/0160405 A1 * 7/2007 Suzuki et al. ..... 400/120.16
2007/0160407 A1 * 7/2007 Suzuki et al. ..... 400/578

FOREIGN PATENT DOCUMENTS

JP 2003251840 * 9/2003
JP 2003-291388 10/2003

OTHER PUBLICATIONS

Computer-generated translation of JP 2003-251840.*
Computer-generated translation of JP 2003-291388.*

* cited by examiner

*Primary Examiner*—Huan H Tran
(74) *Attorney, Agent, or Firm*—Brinks Hofer Gilson & Lione

(57) ABSTRACT

A printer prevents color smear when a paper roll mounted on the printer is initially fed. The printer includes a plurality of printing units each having a thermal head and an ink ribbon, and a platen roller having an outer surface opposite the plurality of printing units. The platen roller can be rotated by a stepping motor. A printing medium is arranged on a roll at the most upstream side of the delivery path. A printed result of a predetermined printing length is obtained by sequentially transferring an ink to the printing medium from the upstream to the downstream printing units in an overlapping manner. The electrification period of the thermal head in each printing unit is controlled on the basis of an amount of rotation of the platen roller.

4 Claims, 2 Drawing Sheets

PRINTER

This application claims the benefit of priority under 35 U.S.C. § 119 to Japanese Patent Application No. 2006-036523, filed Feb. 14, 2006, which is hereby incorporated by reference in its entirety.

BACKGROUND OF THE INVENTION

1. Field of the Invention

The present invention relates to a printer in which a plurality of printing units are disposed about a platen roller. A printing medium is delivered by the roller to the printing units sequentially as the roller rotates so that a desired image can be printed on the medium by each printing unit. Each printing unit sequentially prints a specific ink layer color of the desired image in an overlapping manner.

2. Description of the Related Art

In a printer employing a plurality of ink ribbons of which different color inks are applied, the ink of each ink ribbon is transferred to a printing medium in an overlapping manner to obtain a desired image.

Known printers include a platen roller rotated by a stepping motor and printing units with a plurality of different colors (yellow (Y), magenta (M), cyan (C), and black (K)) arranged about the platen roller at a predetermined interval along a delivery path of the printing medium.

Each printing unit individually includes an ink ribbon, a printing head, and a platen roller. A first printing unit, a second printing unit, a third printing unit, and a fourth printing unit are arranged from an upstream side to a downstream side.

Specifically, each printing unit is disposed tangentially around the platen roller and opposite the printing medium, with the ink ribbon between the platen roller and the printing head. The printing head and the platen roller can be pressed together with the ink ribbon and the printing medium therebetween.

Additionally, the printing medium is delivered from a roll from an upstream side to a downstream side along the delivery path defined by rotation of the platen roller.

In known printers, in order to print a desired image on the printing medium, electrification or activation of a thermal head of the first printing unit is performed. For example, using thermal-transfer of an ink layer of the ink ribbon of yellow (Y), a first image is printed on the printing medium. Sequentially, the area of the printing medium in which the first image is printed is delivered to a second printing unit as the platen roller rotates, where the second printing unit is arranged downstream from the first printing unit. A second image, for example, using an ink layer of an ink ribbon of magenta (M) is applied over the first image by a thermal head of the second printing unit.

Next, the area in which the first image and the second images are printed is delivered to a third printing unit, located further downstream along the delivery path. A third image, for example, using an ink layer of an ink ribbon of cyan (C), is applied over first image and the second image by a thermal head of the third printing unit.

Sequentially, the area in which the first image to the third images are printed is delivered to a fourth printing unit arranged further downstream along the delivery path. A fourth image, for example, using an ink layer of an ink ribbon of black (K), is applied over the first image to the third images by a thermal head of the fourth printing unit. Accordingly, the desired color image is printed on the printing medium (for example, see JP-A-2003-291388).

The printing medium is fed from the paper roll arranged at the uppermost side of the delivery path and is fed to a feed roller and is taken up on an outer surface of the platen roller. The printing medium is provided to each thermal head sequentially from the first printing unit to the fourth printing unit by the rotation of the platen roller such that each ink layer of the ink ribbon is transferred to the printing medium. Once the image is printed, the printing medium is fed to a discharge roller and then is discharged out of the printer, and is cut at a predetermined length by a cutting device.

In such a printing medium, a new roll of printing medium is mounted in the printer and delivered along the outer surface of the platen roller in order to start an initial printing job. In this case, when the leading edge of the printing medium is initially delivered to first printing unit located on the upstream side of the delivery path, the printing medium is not fully wound about the platen roller. Thus, when the first printing unit prints first image on the printing medium, friction between the platen roller and the printing medium is reduced because the printing medium is not fully wrapped about the platen roller, and slippage of the printing medium occurs.

When the second image is printed by the second printing unit, the printing medium is wound about half way about the platen roller. Accordingly, the friction between the platen roller and the printing medium is less than normal, and slippage occurs during printing, and thus the length of the second image is shorter than a desired length. However, the second image is longer than the first image, which experienced even greater slippage.

Additionally, when the third image is printed by the third printing unit, the friction between the platen roller and the printing medium is still less than normal. Accordingly, the slippage still occurs, and thus the length of the third image is shorter than a desired length. Again, however, the third image is longer than the second image.

When the fourth image is printed by the fourth printing unit, the printing medium is fully wound on the platen roller to the same amount that occurs during normal (continuous) printing. Because the printing medium is fully wound about the platen roller, thus insuring sufficient friction between the platen roller and the printing medium, it is difficult for slippage to occur. As a result, the fourth image can be printed at an approximately desired length.

There is a difference in the amount of slippage, and hence a difference in the length of the printing medium properly fed to the printing units between the initial printing by the first printing unit and the printing by the fourth printing unit, that is, when the printing medium is fully wound on the outer surface of the platen roller. This difference is proportional to the area of contact of the printing medium relative to the platen roller. Accordingly, color smears from the first image to the fourth image exist in the initial printed result.

When the printing medium is fully wound on the outer surface of the printing medium by a proper grip of the platen roller, slippage of the printing medium relative to the platen roller does not occur.

As described above, color smear results from the proportional difference in the friction between the printing medium and the platen roller as the printing medium is initially fed onto the platen roller from the roll, to the time the leading edge of the printing medium is wrapped fully around the platen roller.

One way to guarantee the required amount of friction is by not printing until the leading edge of the printing medium approaches the discharging roller arranged at the most downstream portion of the delivery path. This can be done at the time of initial printing by winding the printing medium on the platen roller until it is fully wound about the platen roller. However, in this case, the initial portion of the printing medium is wasted, which leads to unnecessary consumption of the printing medium, which is uneconomical.

SUMMARY OF THE INVENTION

An advantage of the present invention is to provide a printer which prevents a color smear in a simple and economical way.

In order to prevent color smear, a printer includes a plurality of printing units having a thermal head and an ink ribbon, and a platen roller which has an outer surface opposite the plurality of printing units. The platen roller and can be rotated by a stepping motor. The printing medium is delivered from a roll arranged at the most upstream side of the delivery path as the platen roller rotates. A printed result of a predetermined printing length is obtained by sequentially transferring an ink layer of the ink ribbon from the printing units to the printing medium on the basis of a printed data and by overlapping images of different colors.

By controlling the rotational speed of the platen roller, a printing length of the image printed with respect to each printing unit may be adjusted, thereby solving the color smear.

In one embodiment, the roll is mounted in the printer, and the rotational speed of the platen roller is gradually reduced in accordance with an increase in a driving step number of the stepping motor until the printing medium is fully wound on the outer surface of the platen roller. Once that occurs, the rotational speed is set to a normal rotational speed.

At the time of starting a print run in which slippage of the printing medium occurs, the printing length of the image printed by the same printing unit may be controlled in accordance with an amount of the rotation of the platen roller.

Further, another printer includes a plurality of printing units having a thermal head and an ink ribbon and a platen roller which has an outer surface opposite to the plurality of printing units. The platen roller can be rotated by a stepping motor. A printing medium is delivered from a roll arranged on the most upstream side of the delivery path and can be delivered as the platen roller rotates. The printed result of a predetermined printing length is obtained by sequentially transferring an ink layer of the ink ribbon from the printing units arranged in an upstream side of the delivery path with respect to the printing medium by overlapping images to be printed, in which an electrification period of the thermal head in each printing unit is controlled on the basis of an amount of rotation of the platen roller.

Accordingly, by controlling the electrification period of each thermal head of the printing unit, the printing length of the image printed by each printing unit may be adjusted, thereby solving the color smear problem.

The electrification of the thermal head can be adjusted so that the electrification period of the thermal head is gradually reduced in accordance with an increase in a step number of the stepping motor until the printing medium is fully wound about the outer surface of the platen roller. Once the printing medium is fully wound, the electrification period is set to a normal electrification period.

Accordingly, at the time of starting a print run in which the slippage of the printing medium occurs, the printing length of the image printed by the same printing unit may be controlled in accordance with the step number of the stepping motor.

Additionally, when the printing sheet number of paper is equal in each printing unit, an amount change wound on the platen roller of the printing medium is reduced and the electrification period of each printing unit arranged in an upstream side to a downstream side is sequentially reduced.

Accordingly, at the time of starting a printing run in which slippage occurs, the printing length of the same paper printed by the same printing unit may be controlled.

As a result, by controlling the electrification period of each thermal head of the printing unit, the printing length of the image printed by each printing unit may be adjusted, thereby solving the color smear problem.

The printer includes printing units each having an ink ribbon of a different color. Each different color of an ink layer of the ink ribbon results in obtaining a good color image.

As described above, the printer according to the invention can prevent the color smear.

DESCRIPTION OF THE PREFERRED EMBODIMENTS

Figure 1:
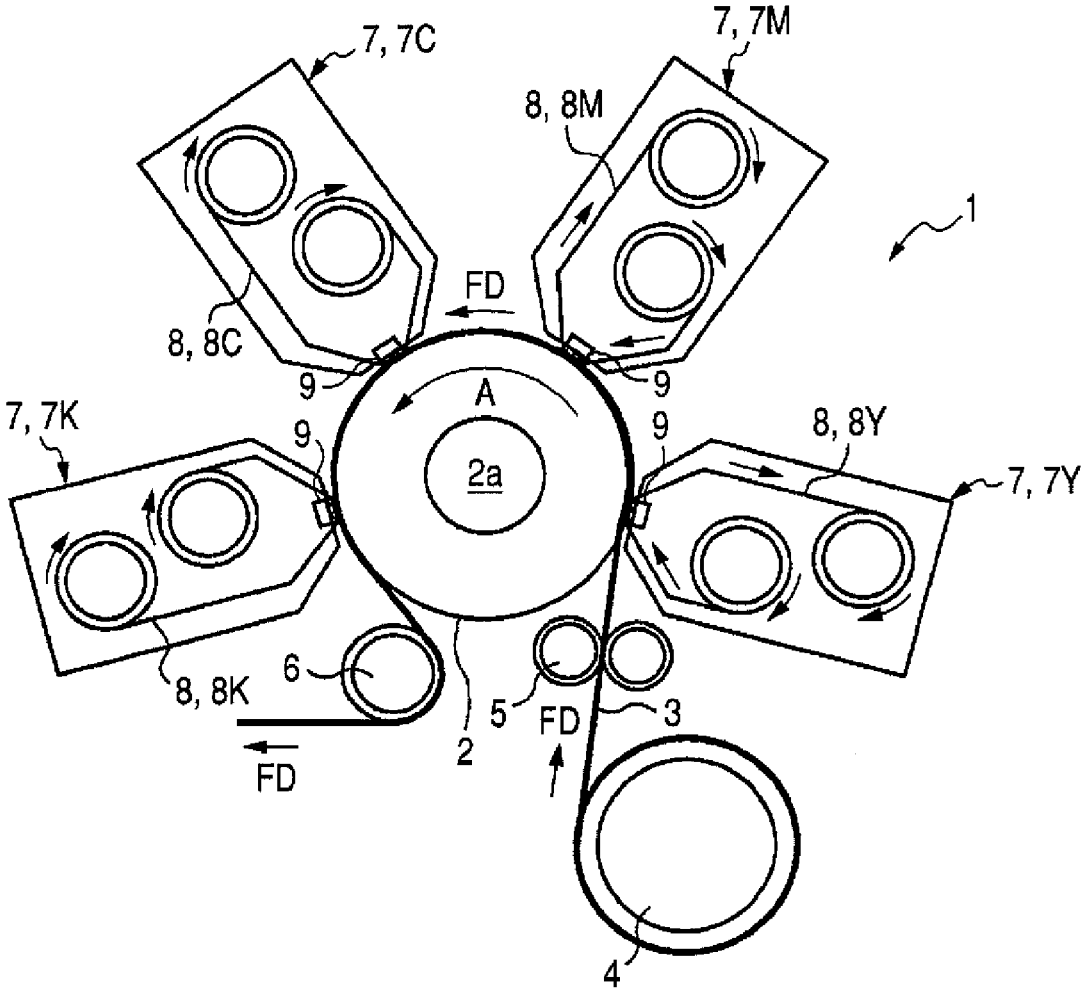
FIG. 1 is a schematic view illustrating a configuration of a printer according to an embodiment.

FIG. 1 is a schematic view illustrating a configuration of a printer according to the embodiment.

According to the embodiment of the invention, as shown in FIG. 1, a rotatable platen roller 2 is arranged inside a chassis (not shown). The platen roller 2 includes a rubber coating (not shown), such as an elastic rubber disposed on an outer surface of the cylindrical platen roller. A rotational axis 2*a* of the platen roller is located at a center of rotation and is supported by a set of bearing (not shown). The rotational axis 2*a* is connected by a driving gear (not shown), which in turn is connected to a stepping motor (not shown), which drives the driving gear such that the platen roller 2 can be rotated in a direction shown by arrow A.

A printing medium 3 is fed from a roll 4 of paper or other selected label material. The printing medium is in the form of a long strip of material wound on the roll. The printing medium frictionally contacts the outer rubber surface of the platen roller. The printing medium 3 contains a plurality of rectangular-shaped labels, and the length of each label is shorter than a distance between printing units located at predetermined intervals along the printing path.

The printing medium 3 is fed from the roll 4 located at the most upstream portion of the delivery path, around the platen roller. After the image is printed, the printing medium 3 is fed to the feed roller 6 and is discharged out of a printer 1.

Each printing unit 7 of a plurality of color inks (yellow (Y), magenta (M), cyan (c), and black (K) is arranged along the delivery path of the printing medium 3 at a predetermined interval so as to be opposite or tangent to the platen roller 2.

Each printing unit 7 includes one color ink ribbon 8 and a thermal head 9, where each thermal head includes a plurality of heater elements formed a direction parallel to the rotational axis 2*a* of the platen roller 2 so as to constitute a line head. From the upstream side (toward the roll 4) in the delivery direction, the following are arranged, namely: a first printing unit 7Y including an ink ribbon 8Y of yellow (Y), a second printing unit 7M including an ink ribbon 8M of magenta (M), a third printing unit 7C including an ink ribbon 8C of cyan, and a fourth printing unit 7K including an ink ribbon 8K of black.

Specifically, each thermal head 9 in the corresponding printing unit 7 is arranged so as to be opposite to the printing medium 3, with the ink ribbon 8 between the printing medium and the printing head. The printing head may be in contact with or separated from (head down/head up) from the platen roller 2. Each ink ribbon 8 within the printing unit is fed through a plurality of pinch rollers (not shown) and is drawn past the thermal head 7 such that the ink ribbon is proximal the printing medium so as to deposit ink on the printing medium. Each ink ribbon 8 deposits an ink layer of the desired color on a surface of the printing medium in the form of a resin film. A winding core 11 within each printing unit may be rotationally driven so as to wind the ink ribbon from a supply core 12 to the winding core 11. The opposite side of each ink ribbon 8 on which the ink is not applied contacts the heater element of the thermal head 9.

By determining when the printing starts on the basis of the step number of the stepping motor, each thermal head 9 of the printing unit 7 performs a "head down" operation to contact the platen roller 2 through the ink ribbon 8 and the printing medium 3. As the platen roller rotates in the direction shown by arrow A, the print head prints on the printing medium 3.

The step number of the stepping motor at the time of starting printing may be the step number when the paper roll 4 is mounted in the printer 1, or may correspond to detection by a sensor (not shown) of a marker on the printing medium 3 indicating that a particular print head senses the location of the marker.

Further, in each printing unit 7 of the printer 1 according to a first embodiment, the rotation number of the platen roller, that is, the step number or count of the stepping motor of the platen roller, is counted from the time the roll 4 is mounted in the printer 1, and changes as the platen roller rotates.

The roll 4 is mounted in the printer 1. The printing medium 3 gradually reduces the rotational speed of the platen roller as the step number of the stepping motor increases. Finally, rotational speed becomes normal when the printing medium 3 is fully wound about outer surface of the platen roller 2, that is, when the leading edge of the printing medium 3 passes the fourth printing unit.

When a location is not synchronous at the time of starting to print an image, and an amount of slippage of the printing medium 3 increases, the width of the asynchronous location increases. Conversely, when an amount of slippage of the printing medium 3 decreases, the width of the asynchronous location decreases. When the printing medium is not fully wound on the outer surface of the platen roller 2, the rotation speed of the platen roller 2 is increased so as to increase the amount of the delivery including the amount of slip of the printing medium 3. Subsequently, the rotational speed of the platen roller gradually decreases and finally reaches the normal rotation speed until the step number of the stepping motor increases and the printing medium 3 is fully wound on about the outer surface of the platen roller 2, that is, until the front end of the printing medium 3 passes the fourth printing unit.

When the printing medium 3 in which the slippage occurs is printed, printing is controlled such that a starting location of printing an image formed in the same printing unit 7 is adjusted to a normal location of starting to print the image.

Additionally, according to the embodiment, the rotational speed of the platen roller set beforehand in accordance with the step number of the stepping motor is stored in a nonvolatile memory (not shown) arranged in the printer 1. The rotation speed of the platen roller may be controlled with reference to data stored in the nonvolatile memory (not shown) at the time of driving the printer.

The rotational speed of the platen roller 2 may be controlled on the basis of the step number of the stepping motor and with reference to the slippage occurring in the delivery of the printing medium, and a printing length of images printed by each printing unit 7 may be adjusted, so that color smear can be improved.

Figure 2:
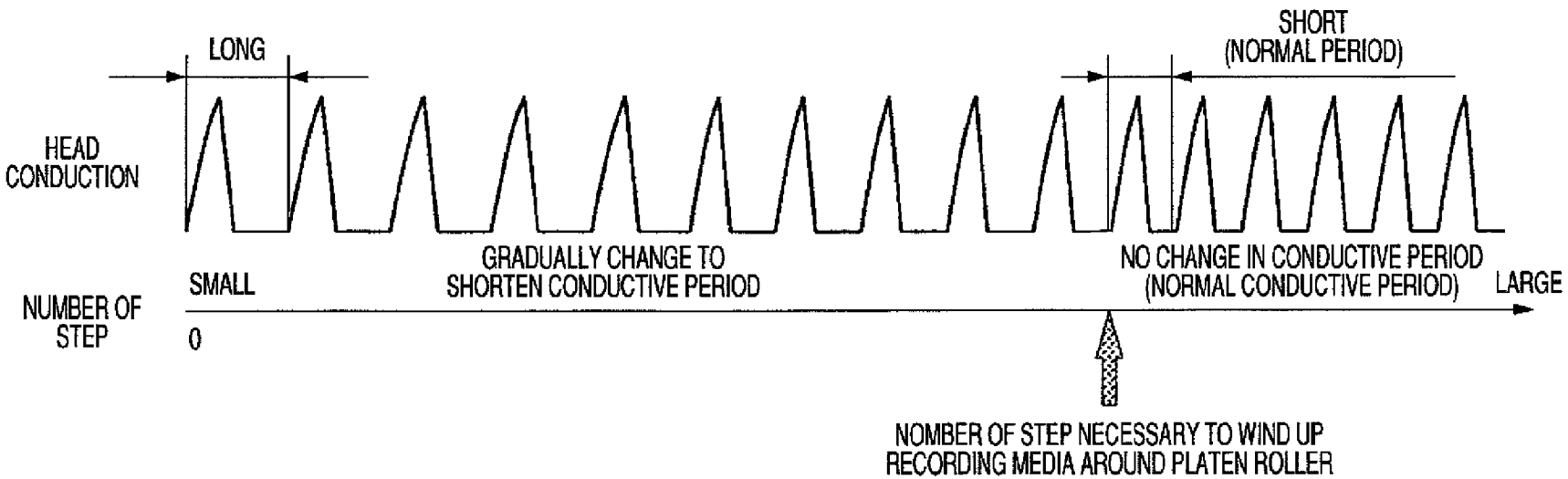
FIG. 2 is a pictorial view of a waveform showing the relationship between the electrification period of the thermal head of a printing unit and a step number of a stepping motor.

FIG. 2 is a conceptual view showing a relationship of a control of an electrification period (activation period) of a thermal head of a printing unit and the number of a driving steps of a platen roller according to a second embodiment.

According to the embodiment, each printing unit 7 controls electrification of a thermal head 9 in accordance with the electrification period of each thermal head 9 on the basis of the number of the driving steps of the platen roller stored in a nonvolatile memory (not shown).

For example, when a rotation speed of the platen roller 2 is normal and the electrification period with respect to the thermal head is lengthened, the printing length of images increases. Conversely, when electrification period with respect to the thermal head is shortened, the printing length of the images decreases.

As shown in FIG. 2, when a step number of the stepping motor representing an amount of rotation of the platen roller 2 is small, and the printing medium is still not fully wound on an outer surface of the platen roller 2, the electrification period with respect to each thermal head is lengthened, and the printing length with respect to a printing medium 3 experiencing slippage is lengthened so as to control the printing. As the step number of the stepping motor increases and the printing medium 3 is gradually wound on the outer surface of the platen roller 2, the electrification period with respect to the thermal head 9 is gradually shorten. Finally, when the printing medium 3 is fully wound on the outer surface of the platen roller 2 and no slippage occurs, the electrification of the thermal head 9 is controlled to a normal electrification period.

As the length of the printing medium wound on the platen roller 2 increases, the electrification period is shortened as the printing medium travels from printing a unit 7Y to s printing unit 7K.

The controlled content of each printing unit 7 is stored in the nonvolatile memory arranged in the printer 1. When a new paper roll 4 is mounted in the printer 1 and is detected, the electrification period described above can be controlled by referring to the nonvolatile memory.

By controlling the electrification period with respect to each thermal head 9 of the printing unit 7 in accordance with the amount of slippage occurring in the printing medium, the printing length of the images printed with respect to each printing unit 7 can be adjusted, and color smear may be avoided.

More specifically, a new roll 4 is mounted in the printer configured according to the second embodiment. Sequentially, when a desired color is printed on each label of the printing medium 3, an electrification period with respect to each thermal head 9 will be described.

First, electrification starts for the thermal head 9 of a first printing unit 7Y, and an ink layer of an ink ribbon 8Y of yellow (Y) is thermally transferred such that a first image is printed in a first sheet of paper of the printing medium 3.

A step number after mounting the paper roll 4 in the printer 1 is much smaller than that at time the printing medium is fully wound about the outer surface of the platen roller 2. Accordingly, during this initial period, the printing medium 3 is only slightly wound about the platen roller 2. Since the friction between the platen roller 2 and the printing medium 3 is very small, a large amount of slippage occurs. Accordingly, the electrification period of the thermal head 9 is set longer.

The first image is printed at a logically long printing length with respect to the printing medium 3 that experienced a large amount of slippage. As a result, the first image of the desired printing length may be obtained.

Sequentially, the first sheet of paper on which the first image is printed is delivered to a second printing unit 7M arranged on a downstream side of the delivery path, and a second image employing an ink layer of an ink ribbon 8M of magenta (M) is overlapped on the first image by a thermal head 9 of the second printing unit 7M.

In this case, the step number after mounting the paper roll 4 in the printer 1 is still smaller than that at the time the printing medium is fully wound about the outer surface of the platen roller 2. Accordingly, the printing medium 3 is fully not wound about the platen roller 2. Since friction between the platen roller 2 and the printing medium 3 is still small, a large amount of slippage still occurs. Accordingly, the electrification period is set longer than normal. The second image is printed at a logically long printing length with respect to the printing medium 3 that experienced slippage. As a result, the second image of the desired printing length overlaps the first image.

In this case, in the first printing unit 7Y, the first image with respect to a second sheet of paper of the printing medium 3 is printed.

Like the above description, since the slippage of the printing medium 3 is not as large as when the previous image was printed, the electrification of the thermal head 9 is set shorter than it was at the time of printing the first image, but still longer than a normal electrification period.

Next, the label printing the first image and the second image is delivered to a third printing unit 7C arranged on the downstream side of the delivery path, and a third image employing an ink layer of an ink ribbon BC of cyan (C) is overlapped on the first image and the second image by the thermal head 9.

In this case, the step number after mounting the paper roll 4 in the printer 1 is a little smaller than that at the time the printing medium is fully wound about the outer surface of the platen roller 2. Accordingly, the printing medium 3 is fully not wound about the platen roller 2. Since friction between the platen roller 2 and the printing medium 3 is very small as well, a small amount of slippage occurs in the delivery of the printing medium 3. Accordingly, the electrification period set shorter than that at the time of printing the second image, but still longer than a normal electrification period. The third image is printed at the logically long print length with respect to the printing medium 3 that experienced slippage. As a result, the third image of the desired printing length overlaps the first image and the second image.

In this case, in the first printing unit 7Y, the first image with respect to a third sheet of paper of the printing medium 3 is printed.

Like the above description, since the slippage occurring in the delivery of the printing medium 3 is small, the electrification period of the thermal head 9 is set shorter than that at the time of printing the first image of the second sheet of paper, but longer than a normal electrification period.

In this case, in the second printing unit 7M, the second image with respect to a second sheet of paper of the printing medium 3 is printed.

Like the above description, since slippage easily occurs, the electrification of thermal head 9 is set shorter than that of the time of printing the second image of the first sheet of paper, but longer than a normal electrification period.

Finally, the label with the first, second and third printed images is delivered to a fourth printing unit 7K arranged on the most downstream side of the delivery path, and a fourth image employing an ink layer of an ink ribbon 8K of black (K) is overlapped on the first image to the third images by the thermal head 9.

In this case, the step number is a little smaller than when the printing medium is fully wound about the platen roller. Accordingly, the printing medium 3 is almost fully wound. Since the friction between the platen roller 2 and the printing medium 3 is almost at normal levels, the slippage is very low. Accordingly, the electrification is set shorter than that at the time of printing the third image of the third printing unit 7C, but still longer than a normal electrification period. The fourth image is printed at the logically long printing length with respect to the printing medium 3 that experienced slippage. As a result, the fourth image of the desired printing length overlaps the first through third image.

Further, in the first printing unit 7Y, the first image with respect to a fourth sheet of paper of the printing medium 3 is printed. Like the above description, since the slippage occurring is extremely small, the electrification for the thermal head 9 is set shorter than that at the time of printing the first image of the third sheet of paper, but longer than a normal electrification period.

Further, in the second printing unit 7M, the second image with respect to a third sheet of paper of the printing medium 3 is printed.

Like the above description, since the slippage occurring in the printing medium 3 is extremely small, the electrification of the thermal head 9 is set shorter than that at the time of printing the second image of the second sheet of paper, but longer than a normal electrification period.

Further, in the third printing unit 7C, the third image with respect to a second sheet of paper of the printing medium 3 is printed.

Like the above description, since the slippage occurring in the printing medium 3 is extremely small, the electrification of the thermal head 9 is set shorter than that at the time of printing the second image of the first sheet of paper, but longer than a normal electrification period.

Additionally, in the fourth printing unit 7K, the fourth image overlaps the first image through the third image, and the ink ribbons 8 of 4 kinds of colors are overlapped so as to form a desired color image. Sequentially, the printing medium 3 is fed downstream by the discharge roller 6 so as to discharge out of the printer 1.

At this time, the printing medium 3 is fully wound on the outer surface of the platen roller 2 and is gripped due to a predetermined friction of the platen rubber 2*a*. Accordingly, the electrification period of each thermal head 7 need not be adjusted with regard to slippage and on the basis of the step number of the stepping motor. As a result, at the following time of printing each image of each printing unit 7, the electrification is controlled according to the electrification period with respect to each thermal head 9.

By controlling the electrification period with respect to each thermal head 9 of the printing unit 7 on the basis of the step number of the stepping motor, the printing length of each image printed with respect to each printing 7 may be adjusted. In terms of the printed result, color smear is simply and economically prevented and a good printed result is obtained.

By providing different colors for ink layers of the ink ribbons 8 arranged in the printing unit 7, a good printed result can be obtained with respect to the color printed images.

Additionally, the invention is not limited to two embodiments, and if necessary, various modifications may be possible.

Besides the method for controlling the step number of the stepping motor according to the first embodiment, for example, a method for arranging a code plate of an encoder with the platen roller and arranging a sensor to detect an amount of rotation of the code plate around the platen roller may be employed.

The embodiments describe that each ink ribbon 8 forms each ink layer of yellow (Y), magenta (M) cyan (C), and black (K) colors, but the color of the ink layer is not limited to these colors, and a mono-color only may be employed.

What is claimed is:

1. A printer, comprising:

a plurality of printing units each having a thermal head and an ink ribbon;

a platen roller having an outer surface, the printing units disposed opposite to the outer surface;

a stepping motor configured to rotate the platen roller; and printing medium in the form of a wound roll arranged at an upstream side of a delivery path;

wherein a printed result of a predetermined printing length is obtained by sequentially transferring an ink layer from the respective ink ribbon to the printing medium in an overlapping manner; and wherein an electrification period of the thermal head in each printing unit is controlled on the basis of an amount of rotation of the platen roller.

2. The printer according to claim 1, wherein when the printing medium delivered from the roll is mounted in the printer with respect to each printing unit, and the electrification period of the thermal head is reduced from a high value to a normal value as a number of steps of the stepping motor increases, until the number of steps of the stepping motor taken indicates that the printing medium is fully wound on the platen roller.

3. The printer according to claim 1, wherein when a number of images printed by each printing unit is equal and an amount of the printing medium wound on the platen roller is changed, the electrification period for the respective printing units from an upstream side to a downstream side is sequentially reduced.

4. The printer according to claim 1, wherein an ink ribbon arranged in each printing unit has an ink layer of a different color.

* * * * *